US009879495B2

(12) United States Patent
Baudoin

(10) Patent No.: US 9,879,495 B2
(45) Date of Patent: Jan. 30, 2018

(54) HYDRAULIC PIPE STRING VIBRATOR FOR REDUCING WELL BORE FRICTION

(71) Applicant: KLX ENERGY SERVICES LLC, Houston, TX (US)

(72) Inventor: Toby Scott Baudoin, Rayne, LA (US)

(73) Assignee: KLX Energy Services LLC, Houston, TX (US)

( * ) Notice: Subject to any disclaimer, the term of this patent is extended or adjusted under 35 U.S.C. 154(b) by 291 days.

(21) Appl. No.: 14/732,494

(22) Filed: Jun. 5, 2015

(65) Prior Publication Data

US 2015/0354307 A1 Dec. 10, 2015

Related U.S. Application Data

(60) Provisional application No. 62/008,279, filed on Jun. 5, 2014.

(51) Int. Cl.

| | |
|---|---|
| ***E21B 31/00*** | (2006.01) |
| ***E21B 28/00*** | (2006.01) |
| ***E21B 34/12*** | (2006.01) |
| ***E21B 34/00*** | (2006.01) |

(52) U.S. Cl.

CPC ..... *E21B 31/005* (2013.01); *E21B 28/00* (2013.01); *E21B 34/12* (2013.01); *E21B 2034/007* (2013.01)

(58) Field of Classification Search

CPC ..... E21B 31/005; E21B 28/00; E21B 34/12; E21B 2034/007; E21B 4/14; E21B 4/00; E21B 4/16; E21B 4/06; E21B 1/00; E21B 34/00; E21B 34/06; E21B 34/14; E21B 34/15; E21B 31/00; E21B 1/12; E21B 7/24; E21B 31/107; E21B 31/113

See application file for complete search history.

(56) References Cited

U.S. PATENT DOCUMENTS

| | | | |
|---|---|---|---|
| 4,384,625 | A | 5/1983 | Roper et al. |
| 5,396,965 | A | 3/1995 | Hall et al. |
| 5,479,989 | A | 1/1996 | Shy et al. |
| 6,237,701 | B1 | 5/2001 | Kolle et al. |
| 6,279,670 | B1 | 8/2001 | Eddison et al. |
| 6,907,927 | B2 | 6/2005 | Zheng et al. |
| 7,139,219 | B2 | 11/2006 | Kolle et al. |
| 7,661,487 | B2 | 2/2010 | Hall et al. |
| 8,230,912 | B1 | 7/2012 | Connell |
| 8,528,649 | B2 | 9/2013 | Kolie |
| 2014/0102804 | A1 | 4/2014 | Cote |
| 2014/0144705 | A1 | 5/2014 | Baudoin |

OTHER PUBLICATIONS

PCT Search Report and Written Opinion issued in related application PCT/US2015/034573, dated Oct. 7, 2015, 8 pages.

*Primary Examiner* — Wei Wang

(74) *Attorney, Agent, or Firm* — Drinker Biddle & Reath LLP

(57) ABSTRACT

A friction reduction apparatus (FRA) positioned onto a pipe string comprises a tubular housing, upper and lower mandrels having variously configured fluid flow passages and ports, a valve and a shifter. Fluid travelling through the apparatus causes the valve and shifter to reciprocate, repeatedly opening and closing flow passages. Each of these cycles creates a pulse in the fluid column creating vibrations that reduce friction in the pipe string. The FRA can be used in conjunction with a ball or dart activated tool positioned downhole from the FRA.

20 Claims, 3 Drawing Sheets

HYDRAULIC PIPE STRING VIBRATOR FOR REDUCING WELL BORE FRICTION

PRIORITY

This application claims priority to U.S. provisional application Ser. No. 62/008,279 filed Jun. 5, 2014 entitled "Hydraulic Pipe String Friction Reducing Apparatus", the entire content of which is incorporated by reference.

FIELD OF THE INVENTION

This invention pertains to downhole equipment for oil and gas wells. More particularly, it pertains to a hydraulic pipe string friction reducing apparatus for use on a wellbore pipe string such as a drillstring or a coil tubing string and, more particularly, this invention relates to an apparatus for inducing a vibration to a pipe string to reduce the coefficient of friction between the pipe string and the wellbore.

BACKGROUND OF THE INVENTION

During the advancement or manipulation of a pipe string in a wellbore such as a drillstring or a coil tubing string, it is often prudent to jar, vibrate, or oscillate the pipe string as an aid in overcoming frictional forces between the pipe string and the interior surface of the wellbore. Vibrations convert static frictional forces to kinetic frictional forces. For this application, a device or apparatus incorporated with a wellbore pipe string to induce pipe string vibration is called a Friction Reducing Apparatus and will be referred to as a "FRA".

A FRA may utilize reciprocating impact elements that move back and forth along the axis of the pipe string and which rely upon the mass and velocity of the reciprocating impacting element to produce pipe string vibration. A FRA may also employ eccentrically weighted rotating masses, eccentric shafts or rods, or rotatable impact elements that rotate about the longitudinal axis of the drill or pipe string to strike an impact anvil to apply a rotational or torsional vibration to the pipe string. A FRA with these types of impact elements typically only generates vibration at a localized segment of the pipe string.

A FRA may also utilize Moineau power sections such as those used in downhole mud motors or pumps to induce pipe string vibration. Moineau power sections usually have sealing mechanisms comprising rubber or rubber-like elastomers. The rubber or rubber-like elastomers of these sealing mechanisms are subject to deterioration over time due to the effects of wellbore temperatures and pressures, drilling fluids, wellbore chemicals, and contaminants or debris in the wellbore.

Many drilling and work-over operations utilize downhole tools or devices incorporated on the pipe string and run into the wellbore. Often an object, generally a ball or dart, pumped through the pipe string from the well surface, activates these downhole tools and devices. The balls or darts are used to close off ports or shift sleeves or pistons. The typical FRA has no direct circulation path or other means to allow a ball or dart to circulate past the FRA to a tool positioned on the pipe string further downhole. Consequently, a ball or dart cannot be circulated through the typical FRA further down the pipe string. If such a downhole tool or device is needed, it cannot be run and activated downhole with the typical FRA. When a typical FRA is utilized on the pipe string, the FRA must be removed before a ball or dart activated tool is used on the pipe string requiring at least one additional trip into and out of the wellbore which is time consuming and costly.

Because of the disadvantages associated with a typical FRA, there is a need for a pipe string FRA that will induce vibration to a larger percentage of the pipe string, or the entire pipe string, without being susceptible to the negative effects of temperature and pressure and other factors associated with a wellbore environment. There is also a need for a pipe string FRA and that will allow the use of the FRA in conjunction with a ball or dart activated downhole tools and devices.

SUMMARY OF THE INVENTION

The present invention is a new FRA for a pipe string that satisfies the aforementioned needs. The FRA disclosed is comprised of a tubular housing retaining interconnected upper and lower stationary tubular mandrels, each having a longitudinal fluid bore. The tubular housing has attachment threads at each end for attachment to a pipe string, coil tubing string, or the like and a central bore through which fluid may be introduced. The fluid introduced through the housing central bore may be a liquid, gas, or a combination of liquid and gas.

The upper and lower mandrels are positioned in the housing within a concentrically positioned reciprocating tubular shifter and a concentrically positioned reciprocating tubular valve. The tubular valve and the tubular shifter are slidably engaged upon the upper and lower mandrels and with each other so the tubular valve and the tubular shifter may translate or move upward and downward along the upper and lower mandrels independently of each other or together.

The interconnected upper and lower tubular mandrels, the reciprocating shifter, and the reciprocating valve are provided with a plurality of radial flow ports and are positioned within the housing to provide a plurality of linearly spaced fluid channels and annular spaces. These fluid channels and annular spaces direct fluid flow through the FRA. This fluid flow translates the shifter and valve upward and downward along the interconnected upper and lower mandrels.

A flow-limiting device may be positioned near the lower end of the longitudinal fluid bore of the lower mandrel. This flow-limiting device may have an integral longitudinal fluid bore restriction or a separate nozzle or orifice threadably or otherwise attached to increase fluid pressure in the FRA.

For operation, fluid introduced into the central bore of the pipe string circulates through the central bore of the tubular housing and into the longitudinal bore of the upper and lower mandrels. A majority of the fluid entering the longitudinal bore of the mandrels travels out of mandrel through a set of the linearly and radially spaced mandrel fluid passages near the upper end of the upper mandrel into the annulus between the inside bore of the outer housing and the outer surface of the shifter. A smaller portion of the fluid entering the longitudinal bore of the mandrels travels through a set of linearly and radially spaced mandrel fluid flow ports away from the upper end of the upper mandrel to provide fluid to the valve. The final portion of fluid will travel directly through the longitudinal bore of both mandrels to exit the lower end of the lower mandrel. The longitudinal bore at the lower end of the lower mandrel may include a longitudinal bore restriction such as a drilled hole, orifice, nozzle, or the like. The introduced fluid then travels through the longitudinal bore of the lower end of the tubular housing and out of the FRA. The restriction in the longitudinal fluid bore of the lower mandrel creates a known increase in pressure within the interconnected upper and lower mandrels. This known pressure is transmitted into the mandrel ports and passages in fluid communication with the valve.

The valve and shifter reciprocate upward and downward in relation to each other and in relation to the upper and lower mandrels based upon the proper placement of the passages and ports of the upper and lower mandrels, valve, and shifter. When the valve slides to its lowermost position, the linearly and radially spaced mandrel fluid passages are substantially open. When the valve slides to its uppermost position, the set of linearly and radially spaced mandrel fluid passages are substantially closed.

The opening and closing of the linearly and radially spaced mandrel fluid passages increases and decreases of fluid pressure in the FRA, which in turn causes pressure fluctuations or pulses in the fluid column in the pipe string upstream of the FRA. These pipe string fluid column pressure fluctuations or pluses cause the pipe string, or coil tubing, to oscillate or vibrate and convert the static friction between the outer surface of the pipe string and the interior surface of the wellbore to kinetic friction. Because kinetic frictional forces are far smaller than static frictional forces, the reduction of these frictional forces allows an operator to extend the pipe string further into a wellbore, particularly a horizontal wellbore, while remaining within the mechanical and physical limitations of the pipe string.

Increasing and decreasing the pressures of the fluid column within the pipe string with the FRA is similar to placing a kink in a water hose then suddenly releasing the kink in a repeated fashion. The process is similar to the pulses created in a water pipe due to the opening and quickly closing of a water faucet. If the faucet is suddenly closed, a pressure wave or surge in the fluid in the pipe will vibrate and rattle the pipe. This phenomenon is sometimes called the "fluid hammer effect". The FRA disclosed does not close or shut off the fluid flow through the FRA as in the examples above, but restricts the flow enough to cause the same vibrational effect.

Closing fluid flow through an FRA while pumping operations are ongoing during drilling or workover operations can cause an unsafe fluid pressure increase in the pipe string. In the disclosed FRA, fluid flow is not closed because the circulating pipe string fluid flowing or traveling through the inner mandrel and through the restriction at the inner mandrel lower end maintains safe fluid pressures in the pipe string.

The new FRA may be configured so the longitudinal fluid bore restriction of the flow-limiting device will allow the passage of a ball or dart to activate downhole tools and devices. The new FRA may also have a flow-limiting device that detaches from the fluid bore of the lower mandrel at a predetermined pressure to move downstream and serve as a dart or ball to activate downhole tools and devices.

DESCRIPTION OF THE EMBODIMENTS

Figure 1:
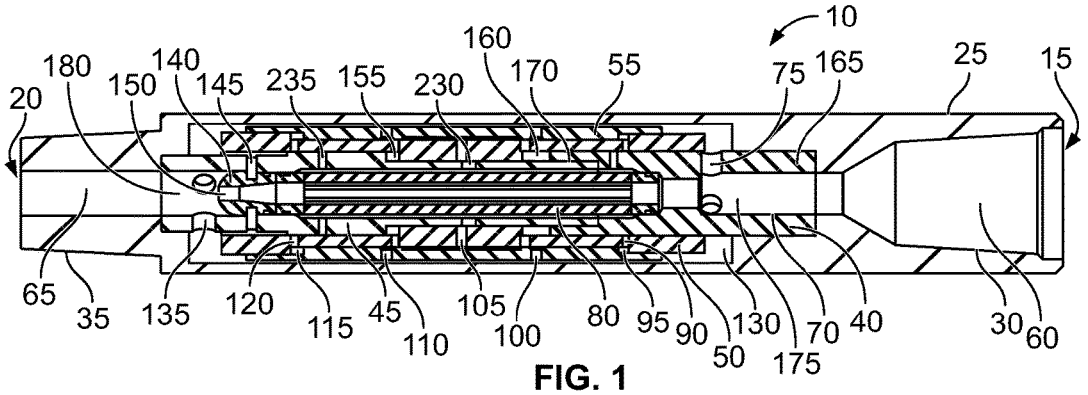
FIG. 1 is a longitudinal cross-section view of the FRA with the valve and shifter in arbitrary positions.
Figure 2:
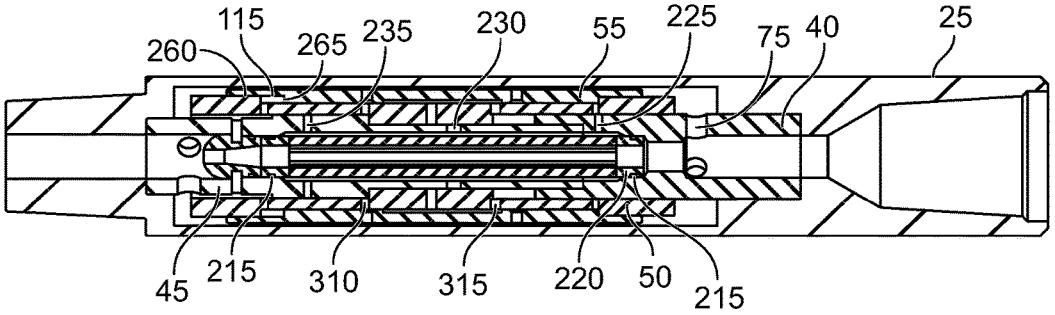
FIG. 2 is a longitudinal cross-section view of the FRA with the valve in the lowermost position and shifter in the uppermost position.
Figure 3:
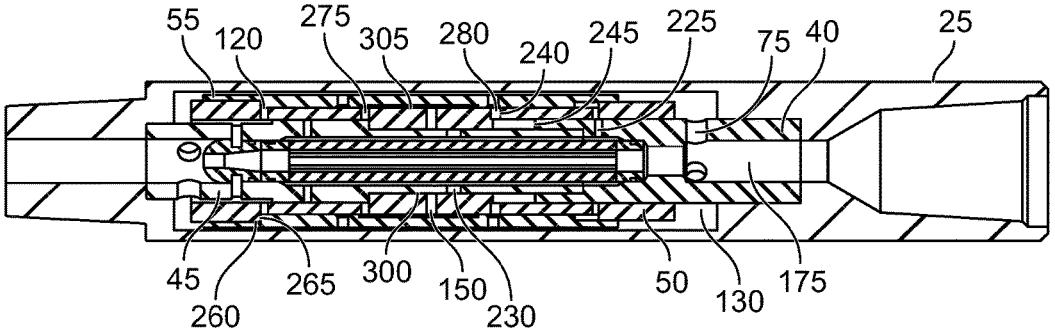
FIG. 3 is a longitudinal cross-section view of the FRA with the valve and the shifter in the lowermost positions.
Figure 9:
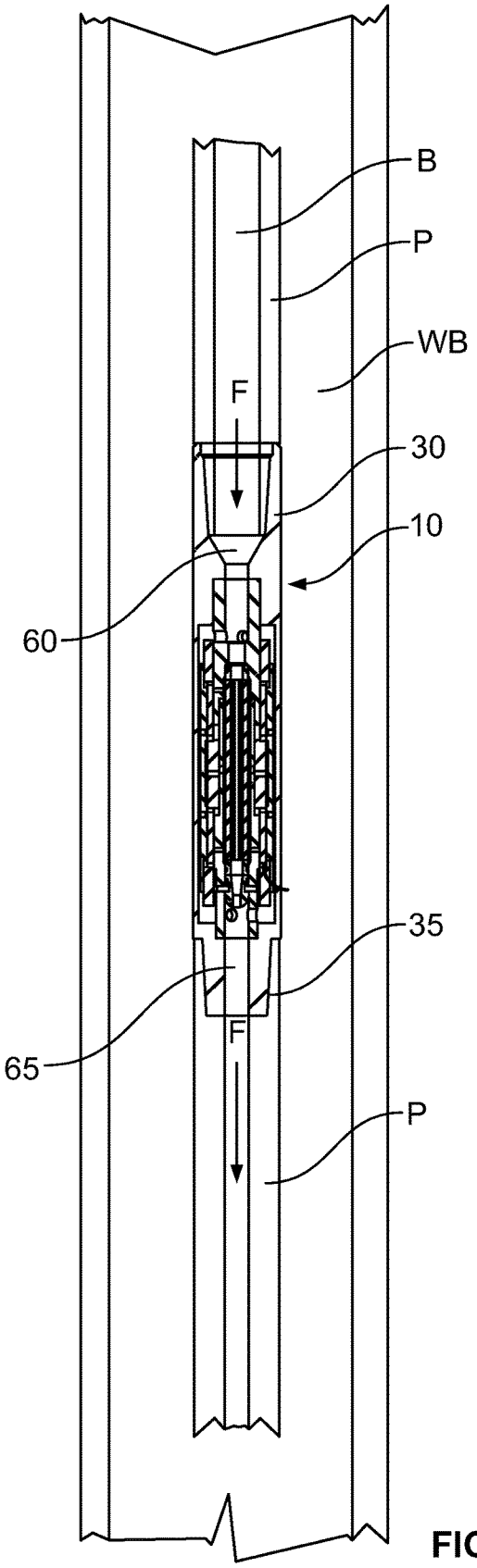
FIG. 9 is an elevation view of the FRA connected to a pipe string in a vertical wellbore

FIGS. 1-3 show an embodiment of the FRA (10) of the present invention. As shown in FIG. 9, the FRA (10) is configured for threadable attachment to a pipe string (P) deployed in a wellbore (WB). The pipe string (P) has a central bore (B) through which fluid (F) may be introduced and circulated. The FRA (10) is positioned on and threadably attached to the pipe string (P) with the FRA (10) extending longitudinally along the axis of the pipe string (P).

FRA (10) is comprised of a tubular housing (25) having an upper end (15) and a lower end (20) and has an upper threaded connection (30) and a lower threaded connection (35) to allow FRA (10) to be threadably attached to the pipe string (P) as shown in FIG. 9. The upper end of the tubular housing (25) has a central bore (60) and lower end has central bore (65) that are in fluid communication with the central bore (B) of the pipe string. Tubular housing (25) is illustrated as a single component but it may include a plurality of individual components threadably or otherwise connected to each other.

Positioned within the housing (25) is a stationary upper mandrel (40) threadably connected at connection (170) to a lower mandrel (45), a concentrically positioned reciprocating tubular shifter (55) that is slidably engaged around a concentrically positioned reciprocating tubular valve (50). Both the shifter (55) and the valve (50) are slidably engaged around the stationary upper mandrel (40) and the lower mandrel (45). Upper mandrel (40) has a lower shoulder (245) and a longitudinal fluid bore (175) in communication with fluid bore (60) of the upper end (15) of tubular housing (25). Lower mandrel (45) has a lower shoulder (250), a longitudinal fluid bore (180) in communication with fluid bore (65) of the lower end (20) of tubular housing (25).

A tubular flow-limiting device (140) is positioned in fluid bore (180) of the lower mandrel (45). The flow-limiting device (140) may have a restricting orifice (150). The flow-limiting device (140) may be affixed in position within fluid bore (180) by shear screws or pins (145) as shown or it may be affixed in position in fluid bore (180) by attachment threads or other suitable means of attachment. When the flow-limiting device (140) is held in place by shear screws (145) as shown, the flow-limiting device (140) may serve as a dart to activate other tools running below the FRA. The lower mandrel (45) may also be manufactured with flow restricting orifice (150) incorporated into a single part eliminating the need for a separate component.

Housing (25), reciprocating tubular shifter (55), and reciprocating tubular valve (50) are positioned around stationary upper mandrel (40) and lower mandrel (45) to create an annulus (130) between the interior wall of housing (25) and the exterior wall of shifter (55), a longitudinal fluid pathway (275), and longitudinal cavities (95) and (115) between valve (50) and shifter (55). This positioning will also create a first annular cavity (300) between the lower mandrel (45) and the valve (50), a second annular cavity (305) between the valve (50) and the shifter (55), a first longitudinal cavity (155) between the lower mandrel (45) and the valve (50), and a second longitudinal cavity (160) between the upper mandrel (40) and the valve (50).

Shifter (55) has a plurality of radially extending flow ports (100) and (110) extending to annulus (130), a lower abutment shoulder (265), an upper abutment shoulder (285), and a plurality of radial fluid ports (120) to provide recurring fluid communication with longitudinal cavity (115) between valve (50) and shifter (55). Valve (50) has a lower shoulder (260) that is slidably engagable with lower shoulder (265) of shifter (55) and an upper shoulder (290) that is slidably engagable with upper shoulder (285) of shifter (55). Valve (50) also has a plurality of radially spaced fluid ports (105) that extend between the first annular cavity (300) and the second annual cavity (305) and a plurality of radial fluid ports (90) to provide recurring fluid communication with longitudinal cavity (95) between valve (50) and shifter (55).

Upper mandrel (40) also has a plurality of radially spaced fluid flow passages (75) extending from longitudinal fluid bore (175) of upper mandrel (40) to annulus (130) and a plurality of radially spaced fluid flow ports (225) extending from longitudinal fluid bore (175) of upper mandrel (40) to reciprocating valve (50). Lower mandrel (45) has a plurality of first radially spaced fluid ports (230) and a plurality of second radial fluid passages or ports (235) extending from the longitudinal fluid bore (180) of lower mandrel (45) to reciprocating valve (50). Lower mandrel (45) also has a plurality of lower radially spaced fluid exit ports (135) extending from longitudinal fluid bore (180) that are in communication with fluid bore (65) at the lower end (20) of tubular housing (25).

Figure 4:
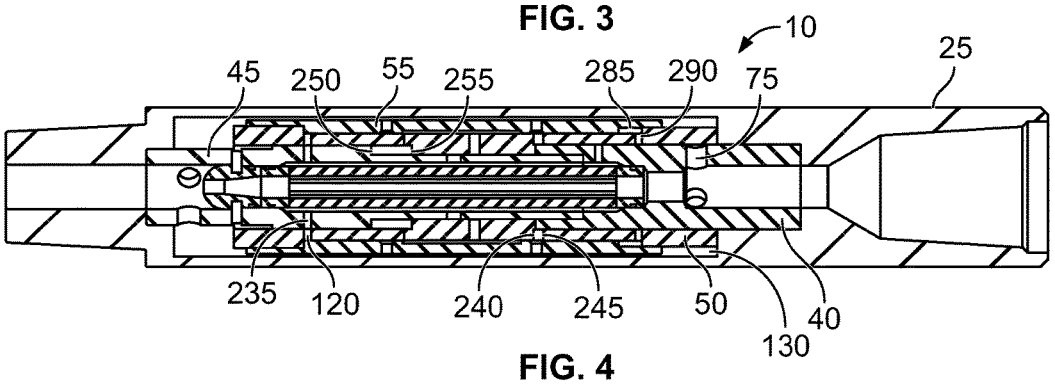
FIG. 4 is a longitudinal cross-section view of the FRA with the valve in the uppermost position and shifter in the lowermost position.

Referring to FIG. 3 and FIG. 4, during operation of FRA (10), fluid (F) in FRA (10) will travel through fluid ports (230) of lower mandrel (45) into cavity (300) where it then travels through ports (105) into cavity (305) of shifter (55) and then into longitudinal pathway (275) between shifter (55) and valve (50). The pressurized fluid will separate shoulder (255) of valve (50) from shoulder (250) of lower mandrel (45) moving valve (50) upwards. When valve (50) travels upwards, shoulder (260) of valve (50) contacts shoulder (265) of shifter (55) to move shifter (55) upwards as well. As valve (50) moves upward, fluid is displaced from cavity (160) through ports (280) and (100) into annulus (130).

The upward movement of both valve (50) and shifter (55) continues until shoulder (240) of valve (50) contacts shoulder (245) of upper mandrel (40), as shown in FIG. 4. Contact of valve shoulder (240) with upper mandrel shoulder (245) will close flow passages (75) in the upper mandrel (40). When the flow passages (75) are so closed, the upstream pressure in pipe (P) will increase. Flow passages (75) will remain closed until such time that shifter (55) travels upwards fully and until valve (50) moves back downwards.

Figure 5:
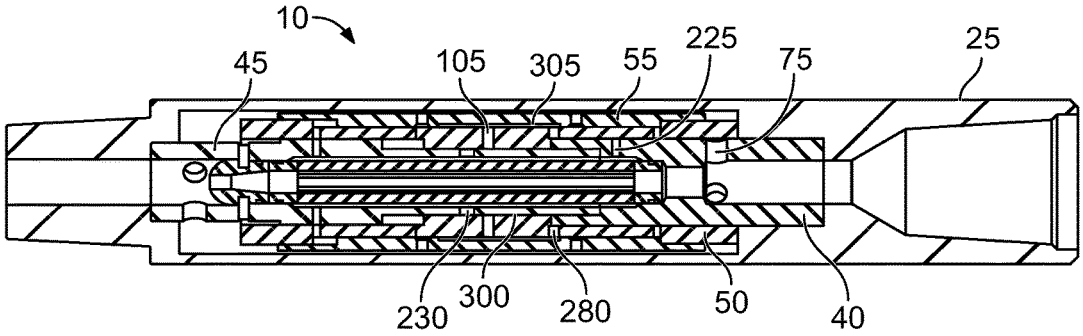
FIG. 5 is a longitudinal cross-section view of the FRA with the valve and the shifter in the uppermost positions.

When shifter (55) travels upwards fully, shoulder (255) of valve (50) is coincident with shoulder (250) of lower mandrel (45) and shoulder (285) of shifter (55) is coincident with shoulder (290) of valve (50) as shown in FIG. 5. At this point, fluid will travel through port (225) of upper mandrel (45) into ports (90) of valve (50) thereby pressurizing cavity (95) and forcing shifter (55) to travel downwards. Shifter (55) will travel downwards until shoulder (265) of shifter (55) contacts shoulder (260) of valve (50), as shown in FIG. 3.

Fluid (F) that enters FRA (10) through fluid bore (60) into the longitudinal fluid bore (175) of upper mandrel (40) and exits through the plurality of fluid flow passages (75) to travel downward through annulus (130) and into ports (135) of lower mandrel (45) to exit FRA (10) through bore (65).

The FRA (10) may be configured to partially or fully open fluid passages (75). The FRA (10) may likewise be configured to partially or fully close flow passages (75). The amplitude of the vibrations created by the FRA (10) is significantly affected by the extent the flow passages (75) are closed. A plurality of flow passages (75) in upper mandrel (40) are shown in the drawings, but FRA (10) may have an upper mandrel (40) with only one flow passage (75) and the flow passages (75) may be of any size, orientation or shape.

Figure 6:
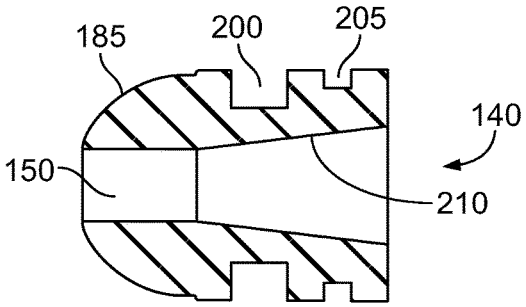
FIG. 6 is a longitudinal cross-section view of an embodiment of flow-limiting device.
Figure 7:
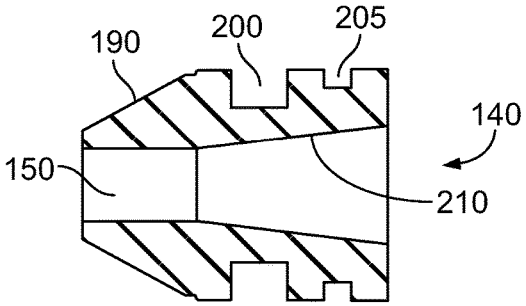
FIG. 7 is a longitudinal cross-section view of a second embodiment of flow-limiting device.
Figure 8:
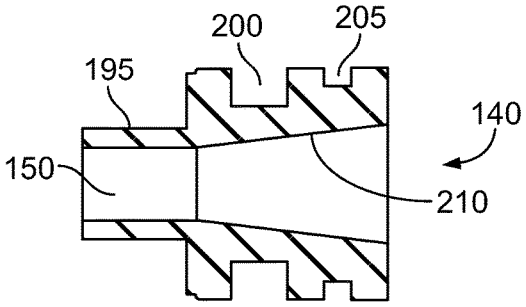
FIG. 8 is longitudinal cross-section view of a third embodiment of flow-limiting device.

FIGS. 6 through 8 show examples of a flow-limiting device (140) in a variety of configurations. The shape, size, geometry, material, and other physical, chemical, and or electrical properties of the flow-limiting device (140) may vary as desired, based on the application for which the FRA (10) will be utilized. Typically, the flow-limiting device (140) will have restricting orifice (150), a plurality of recesses (200) for affixing shear screws or pins, and annular recesses (205) for sealing rings, and an interior surface (210).

FIG. 6 is an embodiment of the flow-limiting device (140) with a rounded or hemispherically shaped nose (185) that simulates a ball. FIG. 7 is an embodiment of a flow-limiting device (140) with a tapered nose (190). FIG. 8 is yet another embodiment of a flow-limiting device (140) with a cylindrical nose. These shapes are merely a few examples of possible geometries that may be used for the flow-limiting device (140) and they are not intended to restrict the scope of this invention. The flow-limiting device (140) may also incorporate a separate, removable nozzle or orifice (not shown) allowing the operator to adjust the bore of restricting orifice (150).

A ball or dart pumped from the surface is required to activate a number of downhole tools. These ball or dart activated tools vary widely depending on the application. Ball or dart activated tools are used in both drilling new wellbores and in performing work in existing wellbores. In typical ball or dart activated tools, the balls or darts are used to open or close (plug off) a port or fluid passage, to shift a sleeve or collet, or to shear a piston or device held in place with an attachment mechanism such as shear screws, shear pins, frictional fitting, collets or the like.

When the flow-limiting device (140) of FRA (10) is used to serve as a ball or dart to activate a downhole tool running downhole from FRA (10), flow-limiting device (140) and the shear screws (145) are configured to allow the flow-limiting device (140) to be completely dislodged from the fluid bore (180) of the lower mandrel (45). Then, preferably, shear screws (145) are used to hold the flow-limiting device (140) in place in fluid bore (180) of the lower mandrel (45). A ball smaller than the outer diameter of the flow-limiting device (140) pumped from surface will seat upon interior surface (210) on the interior bore of flow-limiting device (140) to restrict fluid flow through the flow-limiting device. Pressure will incrementally increase until the shear screws (145) fail (shear). Flow-limiting device (140) will then dislodge from the fluid bore (180) of the lower mandrel (45). When dislodged, flow-limiting device (140) will exit FRA (10) through the central bore (65) of the housing (25) in fluid communication with the central bore (B) of the pipe string (P) and flow downhole to serve as a ball or dart to activate a tool positioned downhole from the FRA (10).

The pressure required to shift the flow-limiting device (140) can be adjusted by changing the size, number, or material of the shear screws (145) as is well known in the art.

Other means of holding the flow-limiting device (140) in place may be used such as friction, collets, shear rings, or similar retaining devices.

If the downhole tools running below the flow-limiting device (140) require a ball smaller than the inside diameter of restricting orifice (150) for activation, then such a ball will travel through flow-limiting device (140) without seating on interior surface (210) and flow-limiting device (140) remain in its position on fluid bore (180) of the lower mandrel (45). The smaller ball will then travel downhole to activate a tool positioned downhole from the FRA (10).

As shown in FIGS. 1-3, a screen (80) may also be used within the bore of the upper and lower mandrels (40) and (45) to extend across fluid ports (225) of upper mandrel (40) and fluid ports (230) and (235) of lower mandrel (45). Screen (80) may include end rings (220) incorporating seals (215). Screen (80) is used to reduce the size of debris allowed into the fluid ports (225) of upper mandrel (40) and fluid ports (230) and (235) of lower mandrel (45). Screen (80) may be of various types such as wire cloth or mesh, perforated metal, wire wrapped screen, or the like and may be of any suitable material including steel, stainless steel, plastics, aluminum, or metal alloys. Screen (80) may be cylindrical, conical or any other suitable shape. If the fluid circulated through the FRA (10) is clean and free of debris, the screen (80) may not be necessary.

FIG. 9 illustrates FRA (10) attached to pipe string (P) in a vertical wellbore (WB). Fluid (F) is circulated through the bore (B) of pipe string (P) and through FRA (10). The FRA (10) is operated by circulating pressurized fluid (F) through the bore (B) of pipe string (P). The FRA (10) can be operated with the valve (50) and shifter (55) in any position. The sequence of movements of the valve (50) and the shifter (55) during operation is illustrated in FIGS. 2 through 5.

In FIG. 2, the valve (50) is in its lowermost position while the shifter (55) is in its uppermost position. In this position, shoulder (255) of valve (50) is coincident with shoulder (250) of lower mandrel (45) and shoulder (285) of shifter (55) is coincident with shoulder (290) of valve (50) as shown in FIG. 5. At this point fluid will travel through ports (225) of upper mandrel (45) into ports (90) of valve (50) to pressurize cavity (95), and force shifter (55) to travel downwards. It will travel downwards until shoulder (265) of shifter (55) contacts shoulder (260) of valve (50), as shown in FIG. 3. Simultaneously, fluid is displaced from cavity (115) through port (120) into annulus (130).

In FIGS. 2 and 3, flow ports (75) of upper mandrel (40) are open to annulus (130). Fluid (F) travels downward through annulus (130) and into ports (135) of lower mandrel (45) then exiting FRA (10) through bore (65). Referring to FIG. 3, pressurized fluid will travel through ports (235) of lower mandrel into cavity (300), then through ports (105) into cavity (305) of shifter (55) into pathway (275). The pressurized fluid will separate shoulder (255) of valve (50) from shoulder (250) of lower mandrel (45) and move valve (50) upwards. As valve (50) travels upwards, shoulder (260) of valve (50) contacts shoulder (265) of shifter (55), causing shifter (55) to move upwards as well. While valve (50) moves upward, fluid is displaced from cavity (160) through port (280) and (100) into annulus (130).

This upward movement of both valve (50) and shifter (55) continues until shoulder (240) of valve (50) contacts shoulder (245) of upper mandrel (245), as shown in FIG. 4, closing fluid passages (75) by valve (50). Fluid passages (75) will remain closed until such time that shifter (55) travels upwards fully and until valve (50) begins to move downward. Upstream pressure in pipe (P) rises as the flow of fluid through passages (75) is restricted. In this position, pressurized fluid will travel through ports (120) and (260) into cavity (115) and separate shoulder (265) of shifter (55) from shoulder (260) of valve (50), moving shifter (55) upwards. Shifter (55) travels upwards until its shoulder (285) contacts shoulder (290) of valve (50). Now, both the valve (50) and the shifter (55) are in the uppermost positions.

When both the valve (50) and the shifter (55) are in the uppermost positions, pressurized fluid then travels through passage (230) into cavity (300), then through ports (105) into cavity (305), on through port (280) where the pressurized fluid separates shoulder (240) of valve (50) from shoulder (245) of upper mandrel (40) causing the valve (50) to travel downward. As valve (50) travels downwards, it moves shifter (55) downwards as well bringing the FRA (10) back to the position illustrated in FIG. 2, relieving pressure through flow ports (75), and completes one full reciprocal cycle.

The frequency at which each cycle operates depends on several factors. This factors include fluid flow rate, stroke lengths of the valve (50) and shifter (55), fluid pathway and port dimensions, the variable volumes of cavities (155) and (160) created between both the upper and lower mandrels (40) and (45), respectively, and valve (50), and the variable volumes in cavities (95) and (115) between the valve (50) and the shifter (55). The fluid introduced through the housing central bore may be a liquid, gas, or a combination of liquid and gas.

The FRA (10) may be configured to partially or fully open fluid passages (75). The FRA (10) may likewise be configured to partially or fully close fluid passages (75). The amplitude of the vibrations created by the FRA (10) is affected by the extent the fluid passages are (75) are opened or closed. A plurality of fluid passages (75) are shown in the drawings, but one or more fluid passages (75) may be utilized and the fluid passages (75) may be of any size, orientation or shape.

The FRA (10) described can be modified or adjusted prior to its use to increase its effectiveness based on a predetermined fluid flow rate. Specifically, the frequency at which the FRA (10) creates pulses in the column of drilling fluid can be set to achieve optimum results.

The FRA (10) will be manufactured without parts containing rubber or rubber substitutes or synthetics, such as those parts used with downhole mud motor power sections (often referred to as Moineau pumps). These power sections typically have a rubber lined stator to form seals onto a rotor causing rotation when fluid is forced through the assembly. This rubber is negatively affected by elevated wellbore temperatures, many types of drilling fluids and chemicals, debris in drilling fluid, nitrogen and other additives to the wellbore. Such rubber often fails or disintegrates when a tool is downhole causing expensive and time-consuming trips into or out of the wellbore.

The FRA (10) will be short in length compared to vibrators that utilize mud motor power sections. Such reduction in length is especially important when the FRA is utilized in coil tubing and or work over applications.

The FRA (10) may also be used with a shock sub or other devices utilized to increase the axial movement of a pipe string. Such devices are primarily used when running jointed pipe.

The FRA (10) described may be utilized in piping systems other than that of a wellbore or oilfield application. For example, the FRA (10) may be used in the cleaning of pipes in a pipeline or in piping systems such as those utilized in a refinery or chemical plant.

It can be seen that the FRA (10) described and shown in the drawings may be utilized in any application where a fluid is being pumped through a conduit and where there is a need to reduce the friction between the conduit and the hole in which the conduit is travelling through.

It is thought that the FRA (10) presented and its attendant advantages will be understood from the foregoing description. It will be apparent that various changes may be made in the form, construction and arrangement of the parts of FRA (10) without departing from the spirit and scope of the invention or sacrificing all of its material advantages, the form described and illustrated are merely an example embodiment of the invention.

I claim:

1. An apparatus for vibrating a pipe string in a well bore comprising:

(a) a pipe string positioned in a well bore, said pipe string having a longitudinal fluid bore;

(b) a column of fluid in said longitudinal fluid bore of said pipe string;

(c) a longitudinally extending tubular housing, said housing having a central bore with a fluid entry and a fluid exit, said fluid entry and fluid exit of said housing in fluid communication with said longitudinal fluid bore of said pipe string whereby fluid from said pipe string fluid column circulates through said housing;

(d) stationary interconnected upper and lower tubular mandrels positioned in said housing, said upper and lower tubular mandrels having interconnected longitudinal fluid bores, said longitudinal fluid bore of said upper mandrel in fluid communication with said fluid entry of said housing and said longitudinal fluid bore of said lower mandrel in fluid communication with said fluid exit of said housing;

(e) a fluid passage extending from said longitudinal fluid bore of said upper mandrel;

(f) a concentrically positioned reciprocatable tubular valve slidably engaged around said upper and lower mandrels;

(g) a concentrically positioned reciprocatable tubular shifter slidably engagable with said tabular valve around said upper and lower tubular mandrels;

(h) fluid circulating through said housing, said fluid creating fluid pressure whereby said shifter reciprocates longitudinally along said upper and lower tubular mandrels to move said valve longitudinally along said upper and lower tubular mandrels to open and close said upper mandrel fluid passage and thereby creating a fluid pressure impulse in said fluid column vibrating said pipe string.

2. The apparatus for vibrating the pipe string in the well bore recited in claim 1 wherein said shifter and said valve reciprocate on said upper and lower mandrels independently or together.

3. The apparatus for vibrating the pipe string in the well bore recited in claim 2 further comprising a flow-limiting device in said longitudinal fluid bore of said lower mandrel.

4. The apparatus for vibrating the pipe string in the well bore recited in claim 3 wherein said flow-limiting device may he disengaged from said lower mandrel to circulate through said pipe suing.

5. The apparatus for vibrating the pipe string in the well bore recited in claim 4 wherein said flow-limiting device serves as a dart to activate a downhole tool.

6. The apparatus for vibrating the pipe string in the well bore recited in claim 5 further comprising a screen within said central bore of said upper and lower mandrels.

7. The apparatus for vibrating the pipe string in the well bore recited in claim 3 wherein said flow-limiting device allows the passage of a ball for activating a downhole tool.

8. In combination with a pipe string positioned in a well bore, said pipe string having a longitudinal fluid bore containing a circulating column of fluid, an apparatus tor vibrating said pipe string in said well bore comprising:

(a) a longitudinally extending tubular housing, said housing having a central bore with a fluid entry and a fluid exit in fluid communication with said longitudinal fluid bore of said pipe string;

(b) stationary interconnected upper and lower tubular mandrels positioned in said housing, said upper and lower tubular mandrels having interconnected longitudinal fluid, bores in fluid communication with said fluid entry and said fluid exit of said housing;

(c) a fluid passage extending from said longitudinal fluid bore of said upper mandrel;

(d) a tubular valve slidably engaged around said upper and lower mandrels;

(e) a tubular shifter slidably engagable with said tubular valve around said upper and lower tubular mandrels whereby said shifter slides along said upper and lower tubular mandrels in response to fluid flow in said circulating fluid column to intermittingly engage and slide said valve along said upper and lower tubular mandrels to open and close said extending fluid passage.

9. The apparatus for vibrating said pipe string recited in claim 8, further comprising:

(a) a plurality of flow ports in said upper and lower tubular mandrels, said shifter, and said valve; and (b) wherein said plurality of flow ports and the positioning of said upper and lower tubular mandrels, said shifter, and said valve within said housing create flow channels and annular spaces directing said fluid through said housing, thereby causing said shifter and said valve to reciprocate along said interconnected upper and lower mandrels.

10. The apparatus for vibrating said pipe string recited in claim 9 wherein said fluid flow through said fluid passage in said upper mandrel is interrupted by reciprocation of said shifter and said valve.

11. The apparatus for vibrating said pipe string recited in claim 10 wherein said upper tubular mandrel has a plurality of fluid passages extending from said longitudinal fluid bore of said upper mandrel.

12. The apparatus for vibrating said pipe string recited in claim 11 wherein changing the size or shape of said plurality of fluid passages in said upper tubular mandrel changes the quantity and direction of said fluid flow through said housing and said interconnected upper and lower mandrels.

13. The apparatus for vibrating said pipe string recited in claim 12 further comprising a flow-limiting device retained in said longitudinal fluid bore of said lower mandrel.

14. The apparatus for vibrating said pipe string recited in claim 13 wherein said flow-limiting device may be disengaged from said lower mandrel to circulate through said pipe string.

15. The apparatus for vibrating said pipe string recited in claim 14 wherein said flow-limiting device is retained in said longitudinal fluid bore of said lower mandrel by shear pins or by shear screws.

16. The apparatus for vibrating said pipe string recited in claim 15 wherein said flow-limiting device serves as a dart to activate a downhole tool.

17. The apparatus for vibrating said pipe string recited in claim 16 further comprising a screen within said central bore of said upper and lower mandrels.

18. The apparatus for vibrating said pipe string recited in claim 13 wherein said flow-limiting device allows the passage of a ball for activating a downhole tool.

19. A method for vibrating a pipe string in a well bare comprising the steps of:

(a) providing a vibrator apparatus comprising: (i) a longitudinally extending tubular housing, said housing having a central bore with a fluid entry and a fluid exit in fluid communication with said longitudinal fluid bore of said pipe string; (ii) stationary interconnected upper and lower tubular mandrels positioned in said housing, said upper and lower tubular mandrels having interconnected longitudinal fluid bores in fluid communication with said fluid entry and said fluid exit of said housing; (iii) a fluid passage extending from said longitudinal fluid bore of said upper mandrel; (iv) a tubular valve slidably engaged around said upper and lower mandrels; (v) a tubular shifter slidably engagable with said tubular valve around said upper and lower tubular mandrels whereby said shifter slides along said upper and lower tubular mandrels;

(b) attaching said housing to the pipe string having a longitudinal bore in communication with said housing fluid entry and said housing fluid exit;

(c) introducing a fluid column in said longitudinal bore of said pipe string;

(d) pumping fluid in said fluid column whereby the fluid enters said vibrator apparatus at said housing fluid entry and exits said housing through said housing fluid exit;

(e) shifting said shifter with said pumped fluid to engage said valve, said engagement causing said valve to reciprocate on said upper and lower mandrels in response to said pumped fluid; and (f) opening and closing said fluid passage in said upper mandrel is interrupted by reciprocation of said shifter and said valve and thereby creating a fluid pressure impulse in said fluid column vibrating said pipe string.

20. The apparatus for vibrating said pipe string recited in claim 19 further comprising a flow-limiting device retained in said longitudinal fluid bore of said lower mandrel.

* * * * *